US007827952B2

(12) United States Patent
Kwak

(10) Patent No.: US 7,827,952 B2
(45) Date of Patent: Nov. 9, 2010

(54) VARIABLE TAPPET

(75) Inventor: Young Hong Kwak, Suwon (KR)

(73) Assignee: Hyundai Motor Company, Seoul (KR)

( * ) Notice: Subject to any disclaimer, the term of this patent is extended or adjusted under 35 U.S.C. 154(b) by 411 days.

(21) Appl. No.: 11/966,486

(22) Filed: Dec. 28, 2007

(65) Prior Publication Data

US 2009/0090319 A1 Apr. 9, 2009

(30) Foreign Application Priority Data

Oct. 5, 2007 (KR) ..... 10-2007-0100308

(51) Int. Cl.
*F01L 1/14* (2006.01)

(52) U.S. Cl. ..... 123/90.48; 123/90.12; 123/90.55; 123/90.65

(58) Field of Classification Search ..... 123/90.16, 123/90.48, 90.52, 90.55, 90.12, 90.13, 90.65
See application file for complete search history.

(56) References Cited

U.S. PATENT DOCUMENTS 6,382,173 B1 * 5/2002 Roe ..... 123/198 F

FOREIGN PATENT DOCUMENTS

KR 1999-0059913 A 7/1999
WO WO 2006002757 A1 * 1/2006

* cited by examiner

*Primary Examiner*—Ching Chang
(74) *Attorney, Agent, or Firm*—Morgan, Lewis & Bockius LLP

(57) ABSTRACT

A variable tappet includes a tappet body; a variable portion in the tappet body, configured to open and close a valve; and a control portion to maintain the variable portion in either a first state, at which it can open and close the valve, and a second state, at which it cannot open and close the valve.

3 Claims, 6 Drawing Sheets

VARIABLE TAPPET

CROSS-REFERENCE TO RELATED APPLICATION

This application claims priority to and the benefit of, Korean Patent Application No. 10-2007-0100308, filed in the Korean Intellectual Property Office on Oct. 5, 2007, the entire contents of which are incorporated herein by reference.

BACKGROUND OF THE INVENTION (a) Field of the Invention

The present invention relates to a variable tappet.

(b) Description of the Related Art

In typical light load driving, the driver uses only around 30% of an engine's maximum power. In these conditions, the throttle valve is nearly closed, and the engine needs to work to draw in air. This causes cylinder pressure to be very low leading to low fuel efficiency.

Cylinder deactivation is thus used at light load so that the throttle valve can be opened further to provide the same power output. This increases pressure in each cylinder. Cylinder deactivation is achieved by keeping the intake or exhaust valves closed for a particular cylinder.

A typical cylinder deactivation apparatus includes a three-part variable tappet, a lock pin, and a double cam. The three parts of the tappet can be separated from one another and cooperate with the double cam to deactivate a cylinder.

The double cam and variable tappet are costly to manufacture and complicated to assemble.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable lappet includes a lappet body; a variable portion in the tappet body, configured to open and close a valve; and a control portion to maintain the variable portion in either a first slate, at which it can open and close the valve, and a second state, at which it cannot open and close the valve.

The variable portion may include a spring in the tappet body; and a variable portion body that is connected to the spring, and rotatable around a shaft in the tappet body.

The control portion may include a pin inserting portion on the tappet body, a pin in the pin inserting portion, an elastic portion in the pin inserting portion for supplying a restoring force to the pin, and a hydraulic line for supplying hydraulic pressure to the pin. The pin may be movable between a first and a second position, corresponding to the first and second states of the variable portion, respectively.

The tappet body may have a groove on a surface thereof and a stopper in the groove.

DESCRIPTION OF REFERENCE NUMERALS INDICATING PRIMARY ELEMENTS IN THE DRAWINGS

| | |
|---|---|
| 100: cam | 200: tappet body |
| 210: groove | 220: stopper |
| 300: variable portion | 310: lost motion spring |
| 320: variable portion body | 330: shaft |
| 400: Control portion | 410: pin inserting portion |
| 420: pin | 430: elastic portion |
| 440: hydraulic line | 500: valve |

DETAILED DESCRIPTION OF PREFERRED EMBODIMENTS

An exemplary embodiment the present invention will be described more fully hereinafter with reference to the accompanying drawings.

Figure 1:
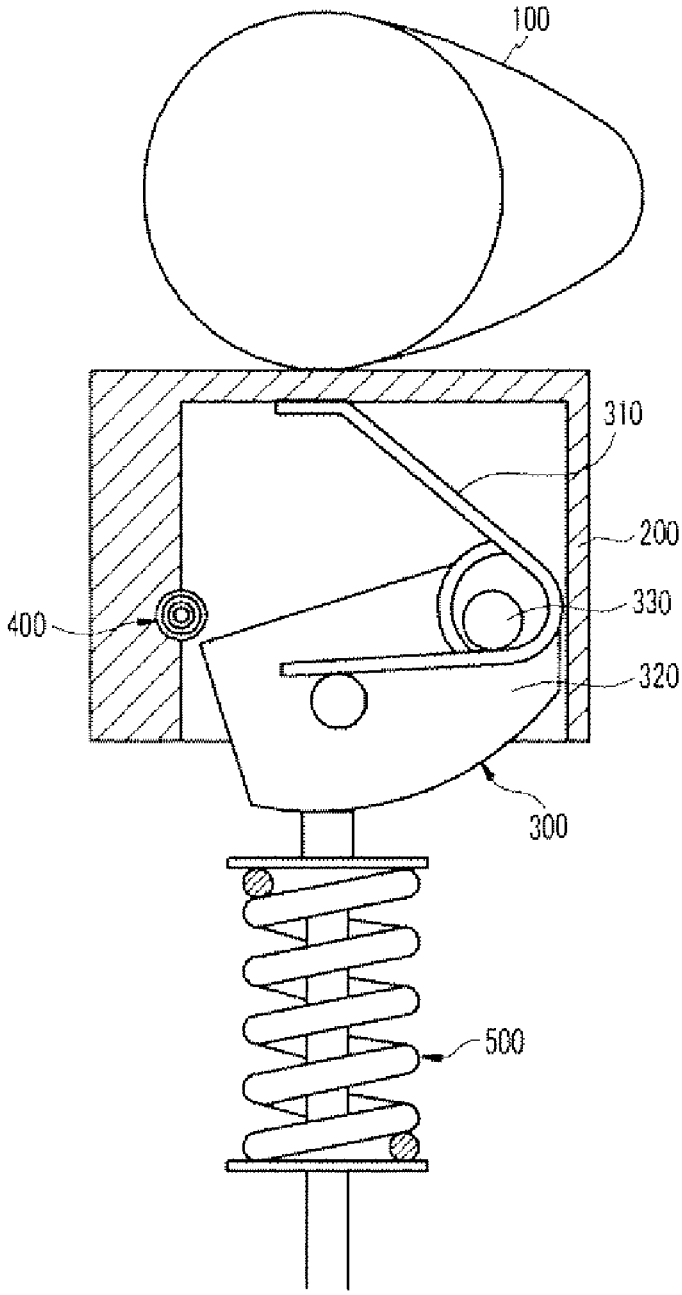
FIG. 1 is a partial cross-sectional front view of a variable tappet according to an exemplary embodiment of the present invention.
Figure 2:
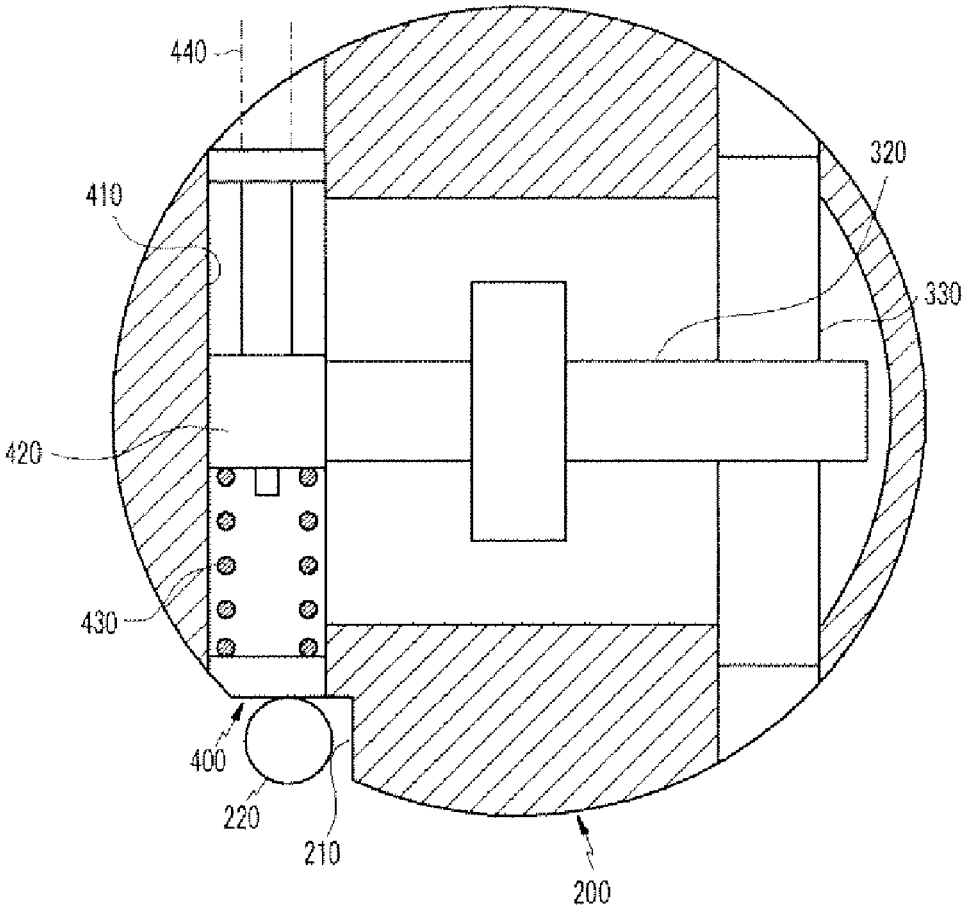
FIG. 2 is a cross-sectional plan view of a variable tappet according to an exemplary embodiment of the present invention in a general mode.

Referring to FIGS. 1 and 2, a tappet body 200 is disposed below a cam 100. A variable portion 300 is provided in the tappet body 200. A lost motion spring 310 connected to the variable portion 300 is disposed in the tappet body 200.

A variable portion body 320 is connected to the lost motion spring 310 and is rotalable around a shaft 330 in the tappet 200. The variable portion 300 is connected to a valve 500 and a control portion 400 selectively rotates the variable portion body 320.

Figure 4:
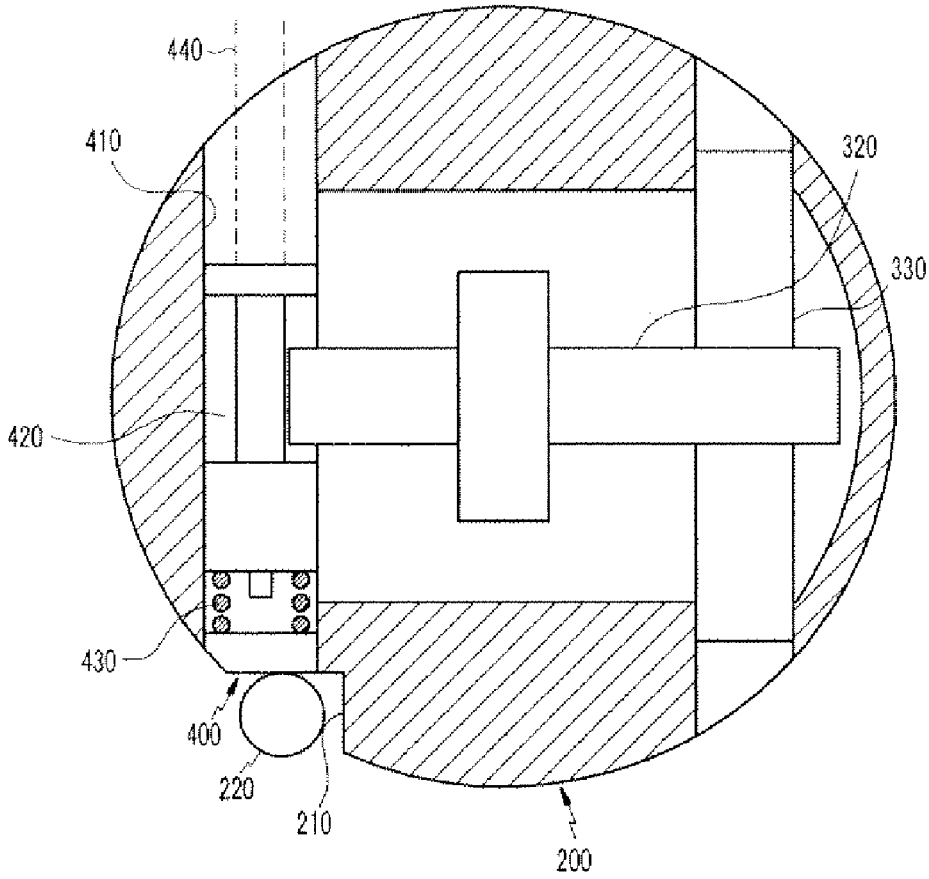
FIG. 4 is a cross-sectional plan view of a variable tappet according to an exemplary embodiment of the present invention in a CDA mode.

The control portion 400 includes a pin inserting portion 410 disposed in the tappet 200, and a pin 420 disposed in the pin inserting portion 410 for selectively allowing the variable portion body 320 to open and close the valve 500 as can be seen by comparing FIGS. 2 and 4.

The control portion 400 includes an elastic portion 430 disposed in the pin inserting portion 410 for supplying a restoring force to the pin 420, and a hydraulic line 440 for supplying hydraulic pressure to the pin 420.

Figure 5:
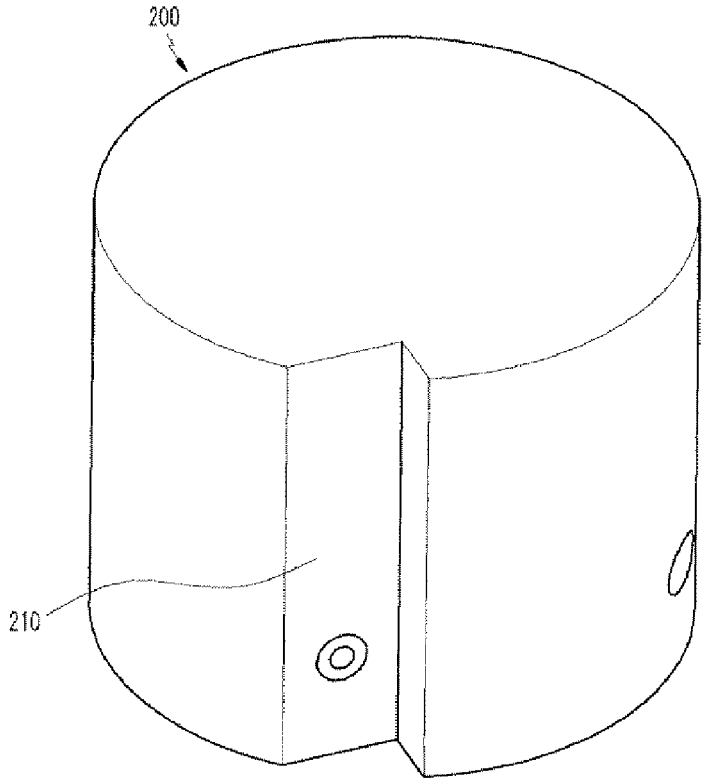
FIG. 5 is a view showing a tappet body of a variable tappet according to an exemplary embodiment of the present invention.
Figure 6:
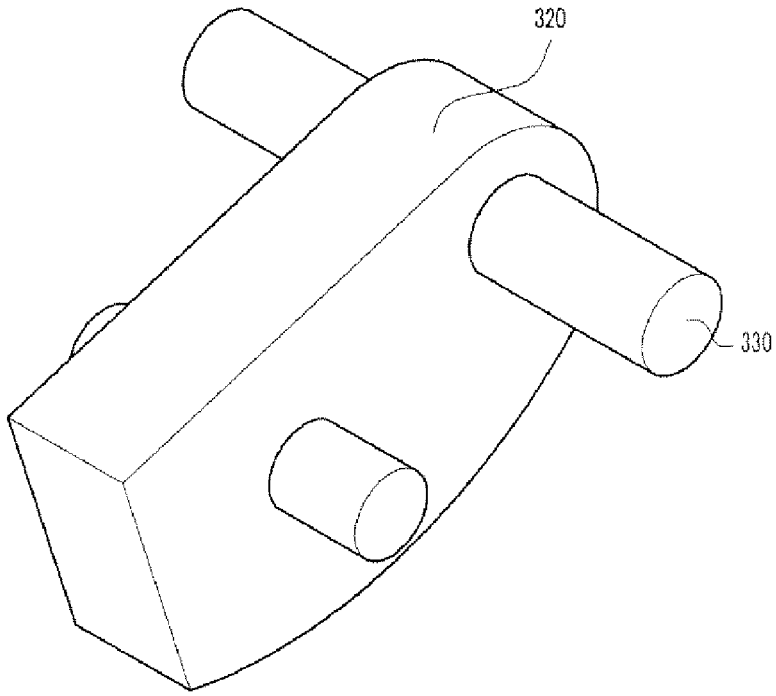
FIG. 6 is a view showing a variable portion body of a variable tappet according to an exemplary embodiment of the present invention.
Figure 7:
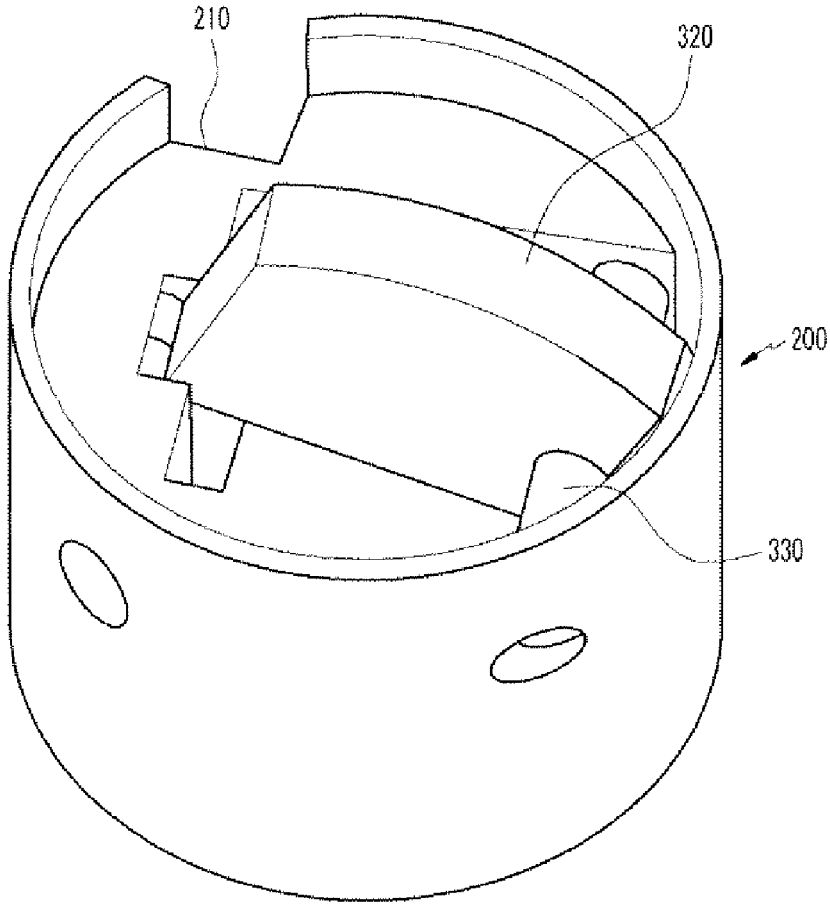
FIG. 7 is a perspective view of the bottom of the valve body of a variable tappet according to an exemplary embodiment of the present invention.

Referring to FIGS. 2, 4, and 5, a groove 210 is provided on an external surface of the tappet body 200 for preventing rotation of the tappet body 200, and a stopper 220 is disposed in the groove 210.

Figure 3:
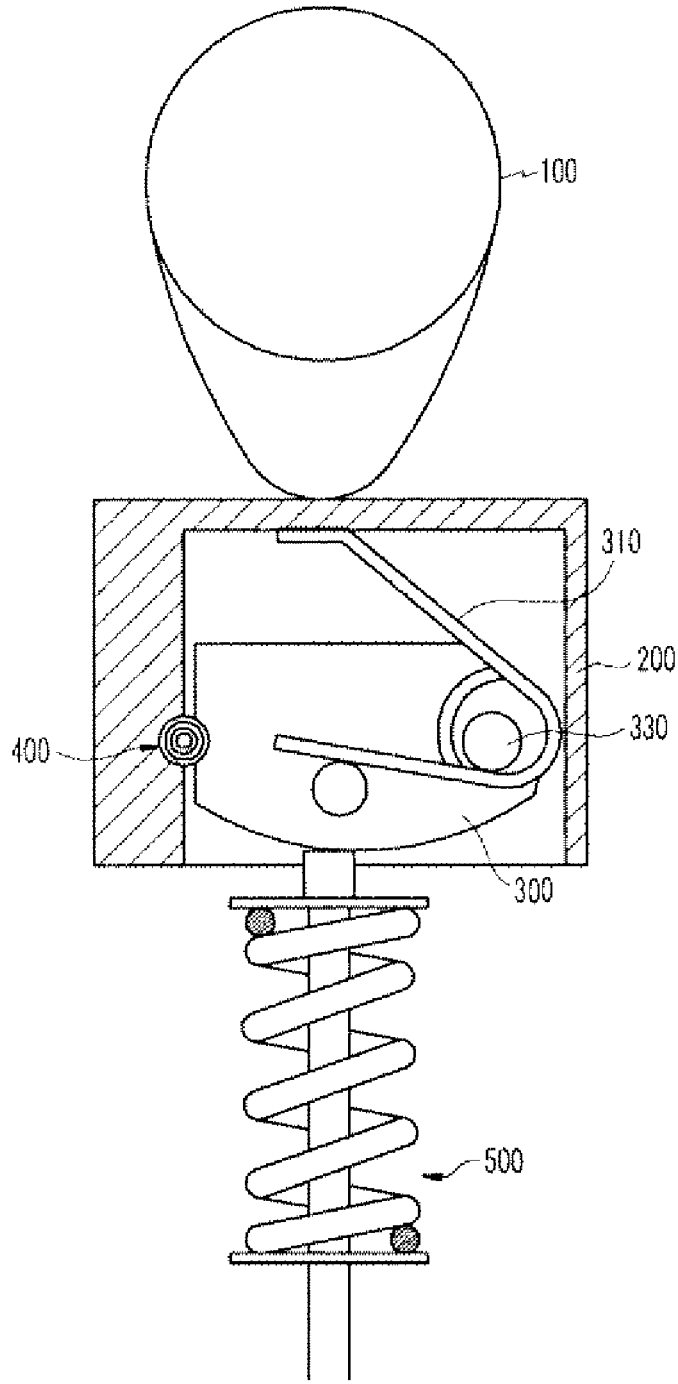
FIG. 3 is a cross-sectional front view of a variable tappet according to an exemplary embodiment of the present invention in a CDA mode.

Operation of the variable tappet according to an exemplary embodiment of the present invention in CDA mode will now be explained, with reference to FIGS. 3 and 4.

When hydraulic pressure is supplied through the hydraulic line 440, the pin 420 moves downward in FIGS. 2 and 4. The variable portion body 320 is then free to rotate around the rotation shaft 330. Thus, the valve 500 is not opened and closed, despite the up-and-down motion of the tappet body 200 caused by rotation of the cam 100.

When hydraulic pressure in the hydraulic line 440 is released, as shown in FIGS. 1 and 2, the pin 420 returns to its original position by restoring force of the elastic portion 430 and the variable portion body 320 cannot rotate. Thus, the variable portion body 320 moves up and down with the tappet body 200, opening and closing the valve 500.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable tappet comprising:

a tappet body;

a variable portion disposed in the tappet body, configured to open and close a valve; and a control portion configured to maintain the variable portion in either a first state, at which it can open and close the valve, and a second state, at which it cannot open and close the valve;

wherein the variable portion comprises:

a spring disposed in the tappet body; and a variable portion body that is connected to the spring, and rotatable around a shaft in the tappet body.

2. The variable tappet of claim 1, wherein the control portion comprises:

a pin inserting portion on the tappet body;

a pin disposed in the pin inserting portion;

an elastic portion disposed in the pin inserting portion for supplying a restoring force to the pin; and a hydraulic line for supplying hydraulic pressure to the pin;

wherein the pin is movable between a first and a second position, corresponding to the first and second states of the variable portion, respectively.

3. The variable tappet of claim 1, wherein the tappet body comprises a groove on a surface thereof, and a stopper disposed in the groove.

* * * * *